United States Patent [19]

Ishikawa et al.

[11] Patent Number: 4,457,507

[45] Date of Patent: Jul. 3, 1984

[54] SHEET FEEDING APPARATUS

[75] Inventors: Massaaki Ishikawa, Hino; Michihisa Iguchi, Komae, both of Japan

[73] Assignee: Tokyo Shibaura Denki Kabushiki Kaisha, Kanagawa, Japan

[21] Appl. No.: 332,156

[22] Filed: Dec. 18, 1981

[30] Foreign Application Priority Data

Dec. 20, 1980 [JP] Japan ..... 55-180954

[51] Int. Cl.[3] ..... B65H 3/52

[52] U.S. Cl. ..... 271/121; 271/171

[58] Field of Search ..... 271/171, 117, 121, 124, 271/125

[56] References Cited

U.S. PATENT DOCUMENTS

| | | | |
|---|---|---|---|
| 2,636,734 | 4/1953 | Loeber | 271/124 |
| 3,963,339 | 6/1976 | Taylor et al. . | |
| 4,346,879 | 8/1982 | Ruenzi | 271/121 |
| 4,374,586 | 2/1983 | Lamos | 271/171 |

FOREIGN PATENT DOCUMENTS

| | | | |
|---|---|---|---|
| 51-51335 | 8/1975 | Japan . | |
| 55-48137 | 4/1980 | Japan | 271/171 |

OTHER PUBLICATIONS

IBM Technical Disclosure Bulletin, vol. 19, No. 6, pp. 1976, 1977, Nov. 1976, "Adjustable Restraint Pad", J. L. Fallon et al.

*Primary Examiner*—Richard A. Schacher

*Attorney, Agent, or Firm*—Cushman, Darby & Cushman

[57] ABSTRACT

A sheet feeding apparatus that can be adjusted to feed various sized sheets includes a fixed paper guide and an adjustable paper guide. A roller in cooperation with a limiting element insures that only a single sheet is drawn from a stack. To prevent uneven feeding and wrinkling, the center of the roller is biased toward the fixed guide from the medial line between the guides when they are separated by a maximum distance. Preferably, the length of the limiting element is shorter than the length of the roller, and when the guides are separated by a maximum distance the medial line between the guides falls along an edge of the limiting means.

7 Claims, 5 Drawing Figures

FIG. 4
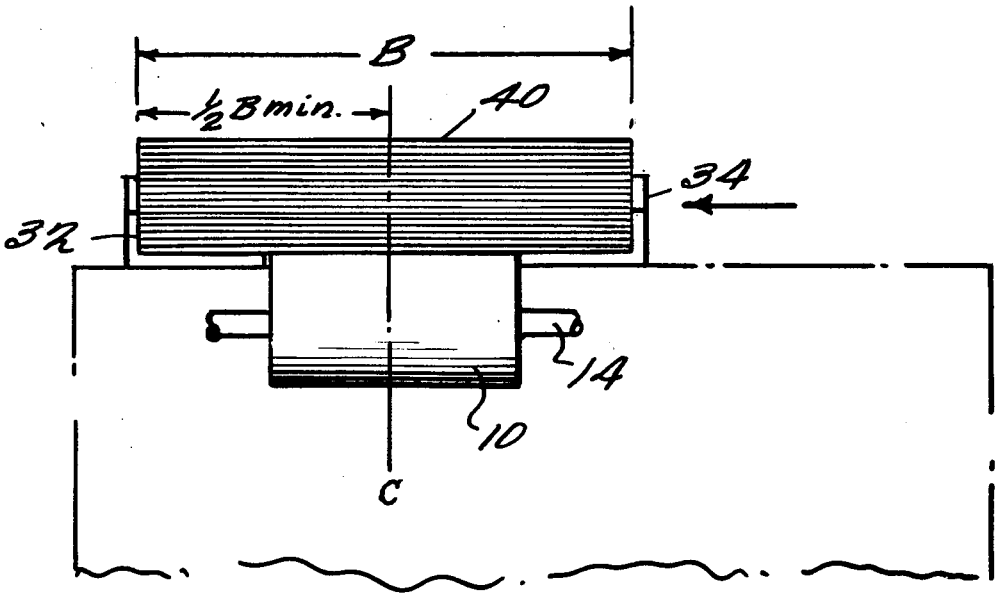
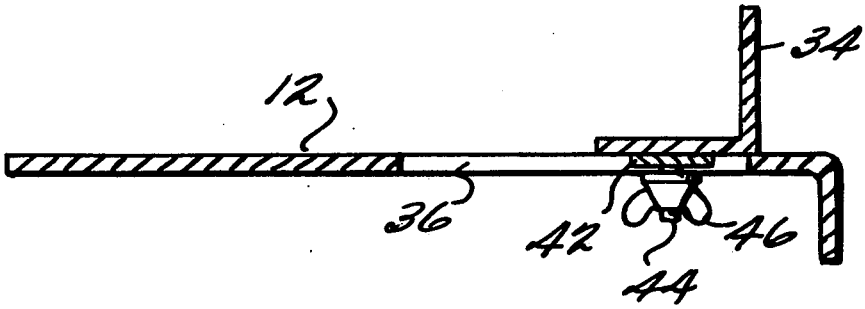
FIG. 5

SHEET FEEDING APPARATUS

BACKGROUND OF THE INVENTION

1. Field of the Invention

The present invention relates to devices for feeding sheets singly from a stack. More particularly, the present invention relates to such sheet feeding devices that can be adjusted to feed various sized sheets.

2. Description of the Prior Art

Devices for feeding sheets singly from a stack have long been necessary in machines such as facsimile machines and copying machines for both originals and copying paper. Such devices include a roller having a friction surface for drawing the sheets from the stack. In order to maximize the friction, the roller has been made as long as the maximum sized sheet to be drawn. A problem has been encountered with such a long roller in that the radii of portions of the roller changes over time. Specifically the radius at each end becomes greater than the radius at the center. This results in loss of friction between the roller and the sheets, thus skewing the sheets.

To overcome this problem, the length of the roller has been reduced so that the radius cannot vary as much.

In copying and facsimile machines, sheet feeding devices have generally included a platform on which the stack of sheets is placed and guides for positioning the stack on the platform. To adjust for sheets of various sizes, it has been customary that the guides be adjustable. In fact, the movement of the guides is typically interdependent so that the stack is always centered on the platform. This arrangement is particularly suited for use with the shortened roller, since the roller will always be centered with respect to the stack.

Machines have comparatively recently been introduced for translating data on sheets into a form usable by computers. These machines generally require precise alignment of one edge of the sheet for reading no matter how large the sheets are. Thus, feeding devices, as described above with two movable guides, are unsuitable for this application, since the positioning of the edges of the sheets is dependent on the size of the sheets.

However, if one of the guides is fixed in position (to position one edge of the sheets independent of size), the position of a short roller will change with respect to the center of the sheets as the size of the sheets changes. In fact, the position of the roller with respect to the center of the sheets may change so much that the sheets will skew or become wrinkled as they are fed.

SUMMARY OF THE INVENTION

The present invention overcomes these problems while providing a feed device employing a short roller in which one edge of the stack to be fed is fixed independent of the dimensions of the sheets in the stack.

In the present invention, the stack to be fed is placed on a platform, between first and second guides. The first guide is fixed while the second guide is adjustable for various sheet widths. Apparatus is provided for drawing sheets from the stack, including a short roller for frictionally engaging the sheets and a stopper for ensuring that only one sheet at a time is drawn. The fixed and adjustable guides define a medial line equidistant between the guides. In the present invention, the centers of the roller and stopper are biased from the medial line toward the fixed guide when the guides are separated by a maximum distance.

In the preferred embodiment, the stopper is a shorter length than the roller, and it is preferable that the stopper should be biased no further than an amount at which the medial line passes along an edge of the stopper when the guides are separated to a maximum extent.

Thus, in the present invention, the position of one edge of the sheets is always the same, independent of the size of the sheets. Also the position of the roller and stopper permits positive and skewless feeding of the sheets independent of size.

BRIEF DESCRIPTION OF THE DRAWINGS

These and other objects and advantages of the present invention will become known and better appreciated from the following detailed description of the presently preferred exemplary embodiments of the present invention, taken in conjunction with the accompanying drawing, of which:

FIGS. 3 and 4 are diagrammatic views for illustrating the biased position of the roller with respect to the sizes of the sheets to be fed; and FIG. 5 is a cross-sectional view of the adjustable slide on the platform taken along the 5—5 line in FIG. 1.

DETAILED DESCRIPTION OF THE PREFERRED EMBODIMENT

Figure 1:
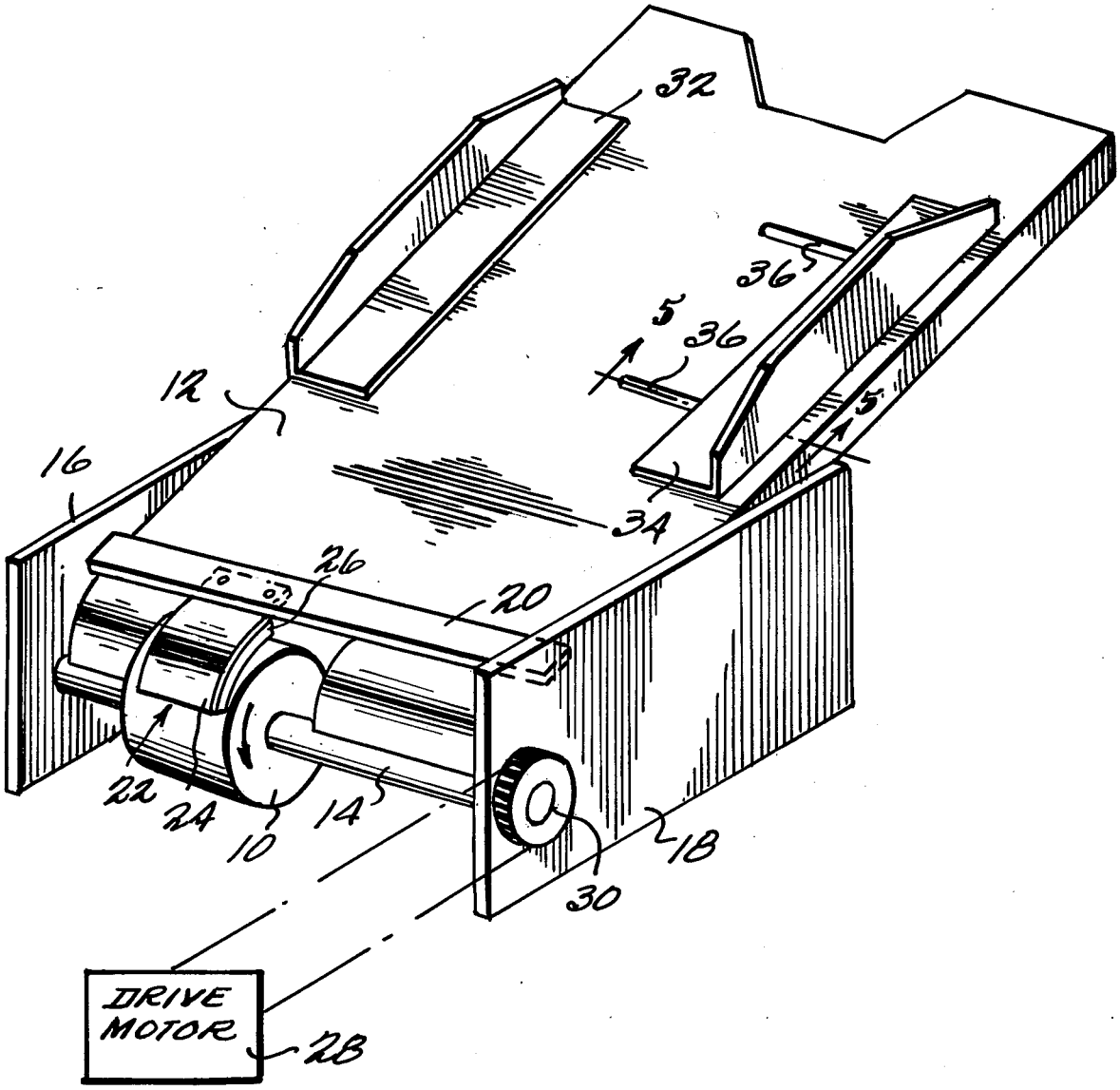
FIG. 1 is a perspective view of one embodiment of the present invention.

Referring now to FIG. 1, the preferred embodiment of the present invention includes a roller 10 having a friction surface for drawing sheets from a stack on a platform 12. Roller 10 is fixed to a roller axle 14 which is rotatably supported by a pair of side plates 16 and 18. Between side plates 16 and 18, a support bar element 20 is attached so as to support stopper or limiting means 22. Stopper or limiting means 22 cooperates with roller 10 for controlling the number of the sheets to be fed and includes a plate spring 24, preferably curved to correspond to the surface of roller 10, and a limiting element 26 of a rubber material which is adhesively attached on the surface of spring 24 facing the surface of roller 10. One end of spring 24 is fixed to support bar 20 to enable control of the pressure between limiting material 26 and the friction surface of roller 10. Roller axle 14 is rotated by a driving means 28 through a gear means 30 which is attached at the end of axle 14.

Guide means are arranged on platform 12 to position the paper stack. The guide means includes a first fixed guide element 32 and a second adjustable guide element 34. Adjustable guide 34 moves along guiding slit apertures 36 of platform 12 in accordance with the sheet size to be fed. Fixed and adjustable guides 32 and 34 define a medial line equidistant between the guides and the frictional engaging means, including roller 10 and the limiting means 22, is arranged at a fixed position with respect to fixed guide 32.

Figure 2:
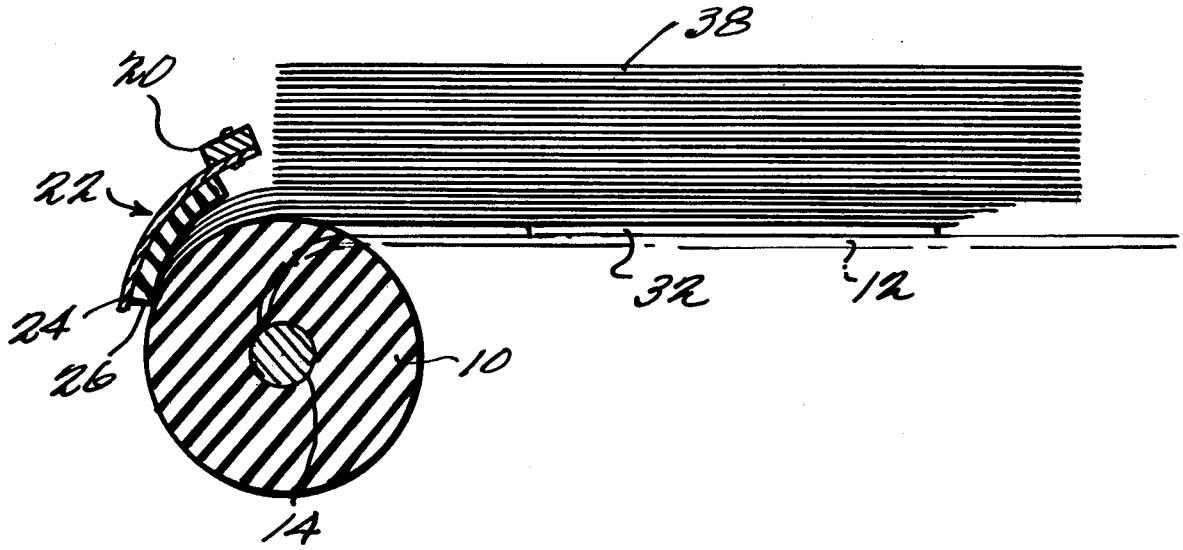
FIG. 2 is a diagrammatic view of the device in FIG. 1 for illustrating the sheet feeding operation of the present invention.

To insure that a single sheet is properly fed from the stack, it is necessary to select the coefficient of friction of the surface of roller 10 greater than the coefficient of friction of limiting means 22. Also, the coefficient of friction of limiting means 22 must be greater than that of the sheets. As shown in FIG. 2, the paper of stack 38 is engaged to be fed by friction roller 10 from the lowest positioned paper of stack 38. Even if more than two papers are drawn at a time by roller 10, limiting means 22 stops other papers except the single lowest paper at that position according to the above-mentioned relationship of the various coefficients of friction.

For this feeding apparatus to be used with input terminals for computers, for example, such as with optical mark readers (OMR), precise alignment of one edge of the papers is required so that timing marks printed on one edge of the respective papers can be read. According to the present invention, guide means for positioning the paper stack includes fixed guide element 32 and adjustable guide element 34.

Figure 3:
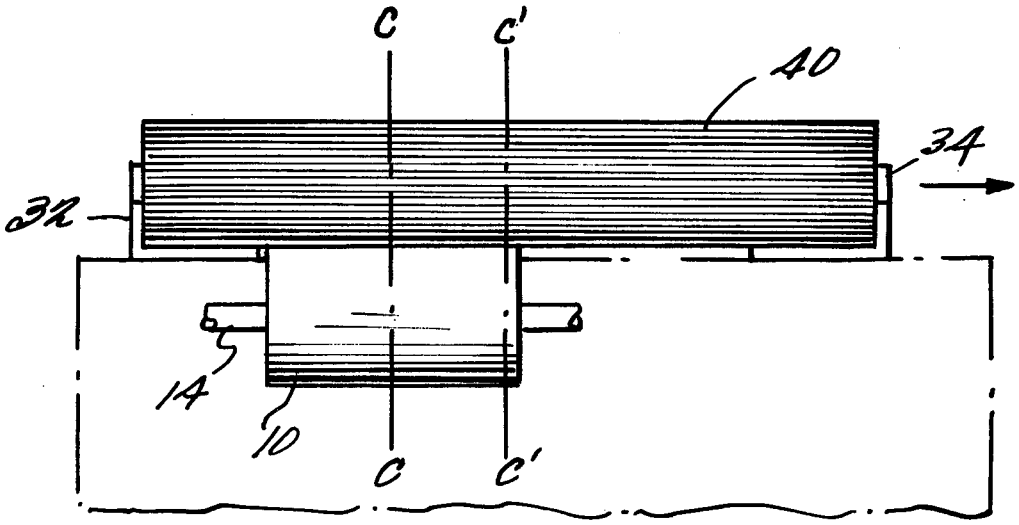

To facilitate even, wrinkle free, feeding, the center of friction roller 10 is disposed from the medial line between guides 32 and 34 toward fixed guide 32 when adjustable guide 34 is at a maximum distance from fixed guide 32 such as shown in FIG. 3. That is, the center line C of the length of roller 10 is biased toward fixed guide 32 when the distance between guides 32 and 34 is maximum. Preferably, the maximum extent of the bias is that the medial line C' of stack 40 passes proximate to the edge of roller 10 toward adjustable guide 34. The length of roller 10 is less than the minimum distance between guides 32 and 34. As shown in FIG. 4, the center line C of roller 10 is about $\frac{1}{2}\times B$ from fixed guide 32 where B is the minimum size paper that can be positioned between guides 32 and 34.

As illustrated in these figures, it is preferable that limiting means 22 has a shorter width than friction roller 10 to prevent the papers from skewing.

As shown in FIG. 5, adjustable guide element 34 on platform 12 is slidably adjusted along guiding slit apertures 36. Adjustable guide element 34 includes a stopper element 42, a threaded projection member 44 and a nut member 46. Nut 46 is released when guide element 34 is slid for adjusting the paper size to be drawn, then once such adjustment is finished nut 46 is bound to fix guide 34 to platform 12.

It is not essential to use nut 46 to fix slidable guide 34 on platform 12. For example, a stopper means made of a rubber material having a slightly wider width than the width of guiding slit aperture 36 can be employed to eliminate the nut binding operation.

Although only a few exemplary embodiments of this invention have been described in detail above, those skilled in the art will readily appreciate that many modifications are possible in the exemplary embodiments without materially departing from the novel teachings and advantages of this invention. For example, it is also possible to install roller 10 in a position to draw the top positioned paper of the stack.

Accordingly, all such modifications are intended to be included within the scope of this invention as defined in the following claims.

What is claimed is:

1. Apparatus for singly feeding sheets of paper from a stack comprising:

guide means for positioning the stack, said guide means including a fixed guide element and an adjustable guide element defining a medial line equidistant from said fixed and adjustable guide elements;

a rotatable roller fixed in position so that the center of said roller length is disposed from said medial line toward said fixed guide when said adjustable guide is at a maximum distance from said fixed guide; and means, cooperating with the roller, for limiting the number of sheets frictionally engaging said roller to one at a time, said limiting means being fixed in position so that said medial line passes through said limiting means when said adjustable guide is at a maximum distance from said fixed guide.

2. Apparatus as in claim 1 wherein:

said limiting means includes means for controlling the pressure between said limiting means and said roller.

3. Apparatus as in claim 1 wherein:

said limiting means is biased toward said fixed guide to the extent that said medial line passes proximate to an edge of said limiting means when the distance between said guides is maximum.

4. Apparatus as in claim 3 wherein:

said rotatable roller has a friction surface for engaging said sheets; and said limiting means has a friction surface proximate said roller friction surface, said limiting means friction surface having a length shorter than a length of said roller friction surface.

5. Apparatus as in claim 4 wherein said roller surface coefficient of friction is greater than said limiting means friction surface coefficient of friction.

6. Apparatus as in claim 1 wherein:

the length of said roller is less than a minimum distance between said fixed and adjustable guides.

7. Apparatus as in claim 6 wherein:

said rotatable roller has a friction surface; and said apparatus further comprises limiting means having a friction surface proximate said roller friction surface, said limiting means friction surface having a length shorter than a length of said roller friction surface.

* * * * *